US006254354B1

(12) United States Patent
Sonnier, Jr. et al.

(10) Patent No.: US 6,254,354 B1
(45) Date of Patent: Jul. 3, 2001

(54) ENHANCED SUCTION GAS MANAGEMENT IN A REFRIGERATION COMPRESSOR

(75) Inventors: W. J. Sonnier, Jr.; Kendall D. Davenport, both of Tyler, TX (US)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/146,119

(22) Filed: Sep. 2, 1998

(51) Int. Cl.[7] ..... F04B 19/24
(52) U.S. Cl. ..... 417/53
(58) Field of Search ..... 417/53, 312, 313, 417/368, 410.5; 62/474, 194, 85, 318, 317; 119/24; 210/826; 96/189; 439/902

(56) References Cited

U.S. PATENT DOCUMENTS

| | | | | |
|---|---|---|---|---|
| 3,736,074 | * | 5/1973 | Kilbane et al. | 417/279 |
| 4,266,408 | * | 5/1981 | Krause | 62/474 |
| 4,412,791 | | 11/1983 | Lal | 417/312 |
| 4,591,318 | | 5/1986 | Elson | 417/312 |
| 4,606,706 | * | 8/1986 | Utter | 417/313 |
| 4,926,081 | | 5/1990 | DiFlora et al. | 310/89 |
| 5,015,155 | | 5/1991 | Brown | 417/360 |
| 5,170,555 | | 12/1992 | Brown | 29/888 |
| 5,176,506 | * | 1/1993 | Seibel | 417/368 |
| 5,232,588 | * | 8/1993 | Gryder | 210/168 |
| 5,344,289 | | 9/1994 | Fasce | 417/312 |
| 5,443,371 | * | 8/1995 | Calciolari | 417/312 |
| 5,562,427 | * | 10/1996 | Mangyo et al. | 417/313 |
| 5,701,668 | * | 12/1997 | Drieman et al. | 29/888.02 |
| 5,733,108 | * | 3/1998 | Riffe | 417/542 |
| 5,873,710 | * | 2/1999 | Tucker | 417/410.5 |
| 5,935,281 | * | 8/1999 | Rotheiser et al. | 55/385.3 |

* cited by examiner

*Primary Examiner*—Teresa Walberg
*Assistant Examiner*—Daniel Robinson
(74) *Attorney, Agent, or Firm*—William J. Beres; William O'Driscoll; Peter D. Ferguson

(57) ABSTRACT

A hermetic reciprocating compressor employs a motor end cap through which suction gas passes in heat exchange contact with the compressor drive motor enroute to the compressor. The end cap has a suction gas aperture and employs apparatus for preventing the entry of debris thereinto and defines a closeable aperture through which the gap between the rotor and stator of the compressor drive motor is accessible during the compressor manufacturing process.

41 Claims, 3 Drawing Sheets

FIG. 1
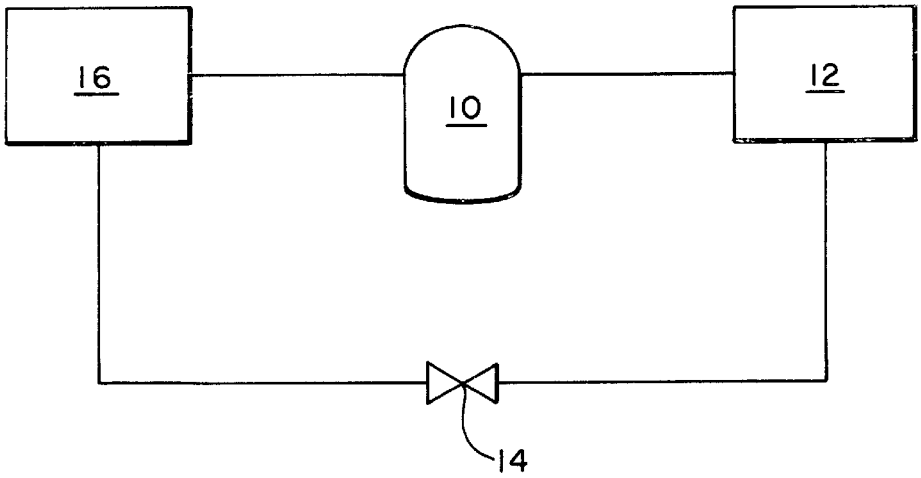
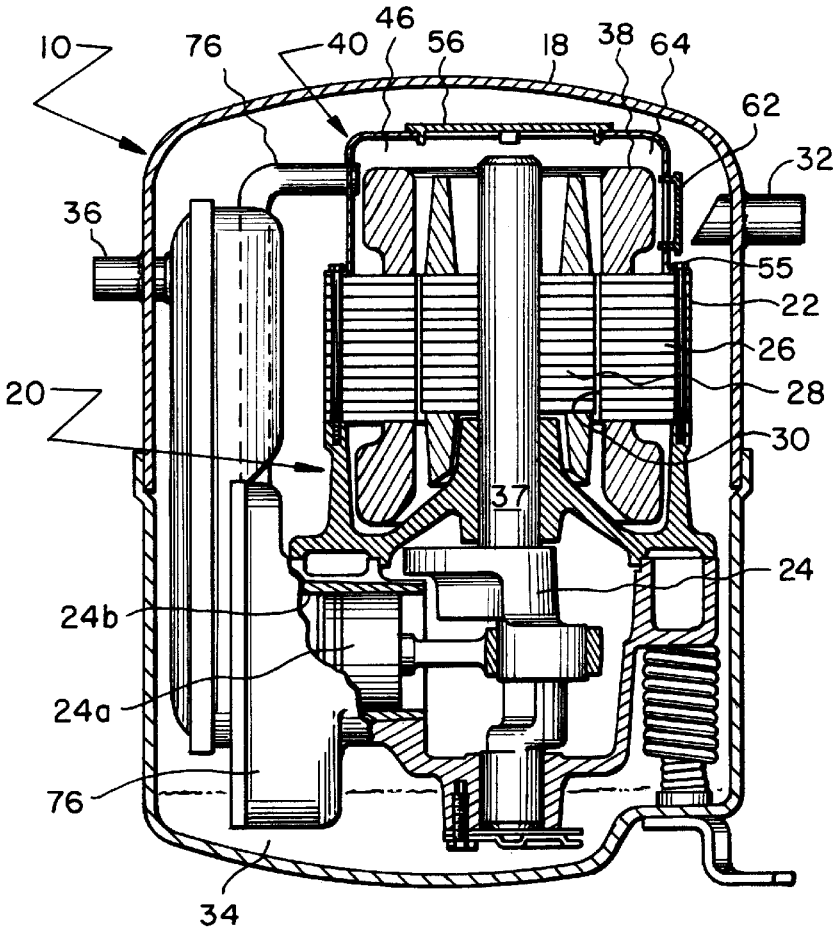
FIG. 2

FIG. 6
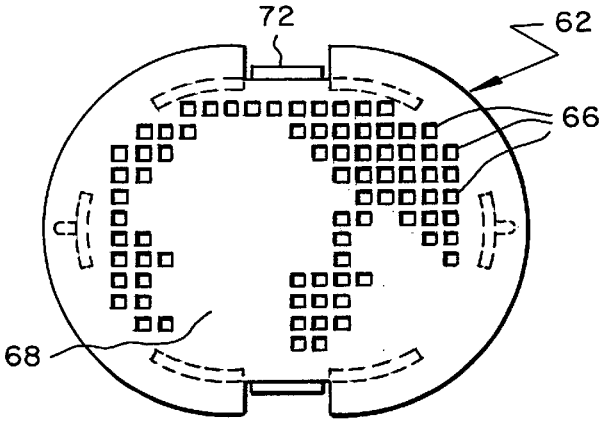
FIG. 7
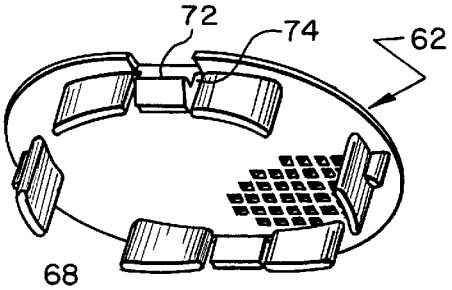
FIG. 8
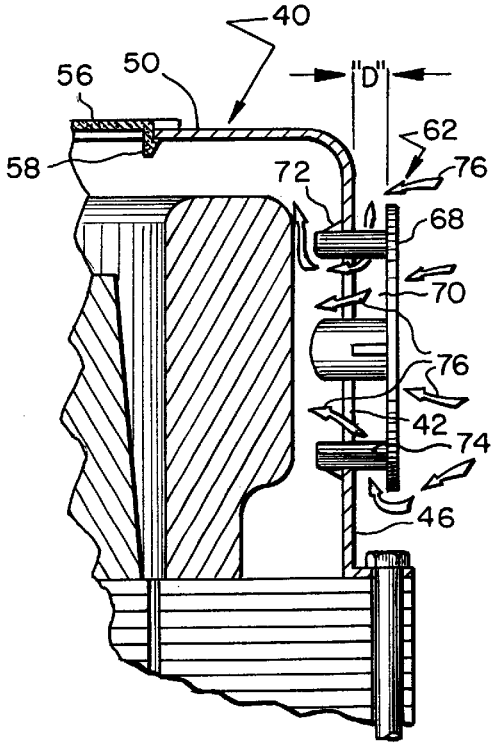
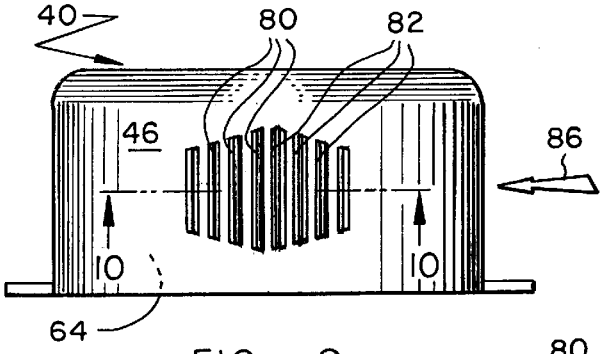
FIG. 9
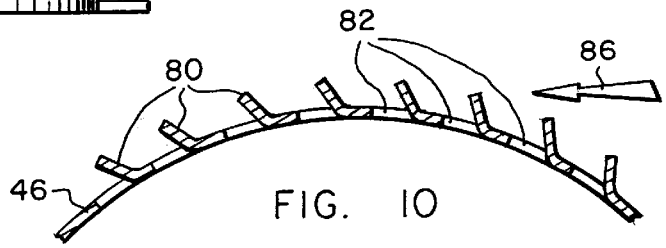
FIG. 10

ENHANCED SUCTION GAS MANAGEMENT IN A REFRIGERATION COMPRESSOR

BACKGROUND OF THE INVENTION

The present invention relates to hermetic refrigeration compressors and to the flow of suction gas into the shells thereof. With more particularity, the present invention relates to refrigeration compressors of the reciprocating type in which the flow of suction gas to the compression mechanism within the shell of the compressor is to and through a motor end cap and suction tube. With still more particularity, the present invention relates to an improved motor end cap/suction tube arrangement by which the flow of suction gas into and through the shell of a hermetic refrigeration compressor is managed so as to prevent the carrying of debris into the compression apparatus and to enhance the cooling of the motor by which the compression apparatus is driven.

Hermetic refrigeration compressors are compressors in which a motor-compressor combination is mounted internal of a hermetic shell. Such compressors are used in refrigeration systems such as air conditioners, heat pumps and the like for purposes of compressing refrigerant gas from a lower (suction) pressure to a higher (discharge) pressure.

Certain of such compressors are so-called low-side compressors meaning that the interior of the shell in which the motor-compressor is disposed contains refrigerant gas at suction pressure. Such gas surrounds the motor-compressor assembly and is drawn therefrom into the compression mechanism. The suction gas in a refrigeration compressor is a relatively low pressure gas which, even though relatively warm in terms of comparative refrigerant temperatures in other portions of the refrigeration system, is low enough to cool the still higher temperature motor portion of the motor-compressor by flow over, through and around it.

The use of motor end caps and suction tubes to channel the delivery of suction gas to the compression mechanism of a refrigeration compressor in a manner which cools the motor by which the compression apparatus is driven has long been known and there have been many improvements in such arrangements over the past decades. The use of motor end caps in such compressors, while advantageous, does bring certain disadvantages and difficulties that must be overcome in order to permit their use without adversely affecting suction gas flow or unnecessarily complicating compressor fabrication.

Among the disadvantages/difficulties that must be overcome when a motor end cap and suction tube arrangement is employed in a compressor is the need to minimize pressure drop in the suction gas flowing to the compression apparatus as a result of the use thereof. Further, the use of an end cap, which overlies the motor of the compressor, can potentially complicate the compressor assembly process which requires that a predetermined gap be set between the stator and rotor of the compressor drive motor once these components have been assembled into place during the compressor's manufacture. The setting of the rotor-stator gap requires access to the motor for that purpose and the use of a motor end cap, which is most often attached directly to and overlies the motor's stator, poses an obstacle to access to the rotor-stator gap. Difficulties in setting the rotor-stator gap can therefore be encountered to the extent that the end cap, in the process of its assembly to the motor-compressor, blocks access to and/or observation of the rotor-stator gap for gap setting purposes.

The need continues to exist for an improved motor end cap/suction tube arrangement in a refrigeration compressor which minimizes pressure drop in the flow of suction gas enroute to the compression mechanism, which prevents the entry of debris into or onto the compressor drive motor and compressor portions of the motor-compressor combination and which facilitates compressor manufacture and assembly by providing access to the rotor-stator gap so as to permit the setting of that gap conveniently and at minimal expense.

SUMMARY OF THE INVENTION

It is an object of the present invention to provide a motor end cap in a refrigeration compressor which minimizes pressure drop in the suction gas flowing into and through it.

It is another object of the invention to provide a motor end cap in a refrigeration compressor which prevents debris from entering into or onto both the motor and compression apparatus while permitting essentially unobstructed flow of suction gas over the motor, for motor cooling purposes, and into the compressor without significant pressure drop therein.

It is a still further object of the invention to provide a motor end cap in a refrigeration compressor which is conveniently and inexpensively assembled to the compressor drive motor yet which allows convenient access to the rotor-stator gap of the motor for purposes of setting that gap during the compressor assembly process.

These and other objects of the present invention, which will become apparent when the attached Drawing Figures and following Description of the Preferred Embodiment are considered, are accomplished by a motor end cap arrangement in a refrigeration compressor which, by its definition of a closeable aperture, provides convenient access to the rotor-stator gap of the compressor drive motor for purposes of setting that gap during compressor manufacture and which, by the use of a suction screen that stands off of the entry location for suction gas into the interior of the end cap, prevents the entry of debris into the motor end cap while permitting essentially unobstructed suction gas flow thereinto. Pressure drop in the gas flowing to the compression apparatus, to the extent it is caused by virtue of the use of the motor end cap is thereby minimized while the motor and compressor are, at the same time, protected from the adverse affects of debris that would otherwise carried onto or into them.

DESCRIPTION OF THE DRAWING FIGURES

FIG. 1 is a schematic illustration of a typical refrigeration/air conditioning circuit.

FIG. 2 is a cross-sectional view of the compressor of the present invention.

FIG. 6 is a top view of the end cap suction inlet screen.

FIG. 7 is a bottom perspective view of the end cap inlet screen.

FIG. 8 is a partial side view of the motor end cap with the inlet screen assembled thereinto illustrating the unobstructed side openings for suction gas entry that are defined by the suction screen and end cap.

FIGS. 9 and 10 illustrates an alternative embodiment of the present invention wherein use of a separate suction screen is dispensed with in favor of the use of integral louvers formed in the motor end cap.

DESCRIPTION OF THE PREFERRED EMBODIMENT

Figure 3:
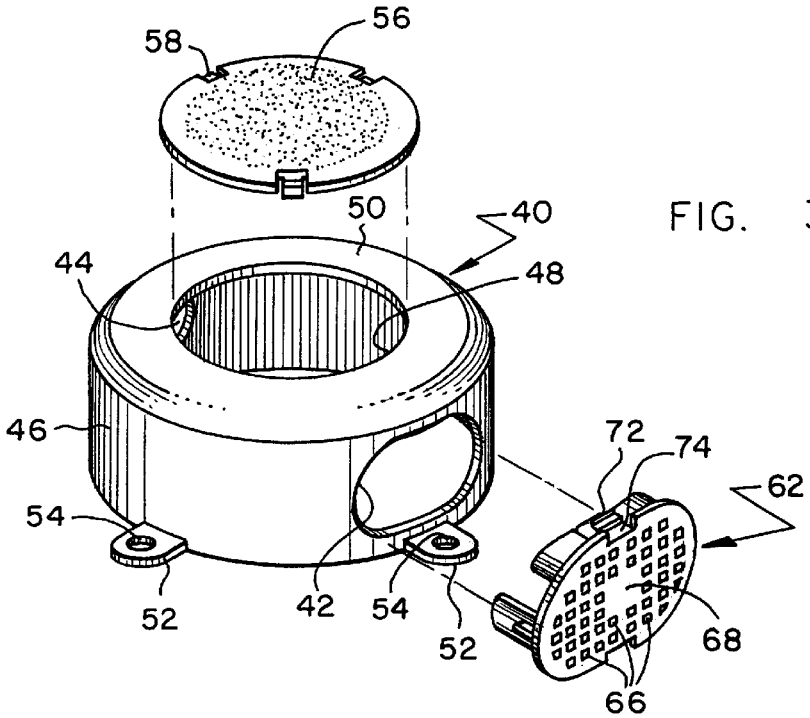
FIG. 3 is a perspective view of the motor end cap of the compressor of the present invention.

Referring first to FIG. 1, a typical refrigeration/air conditioning circuit is illustrated. Such circuits typically include a compressor 10, a condenser 12, a metering device 14 and an evaporator 16. Compressor 10 compresses refrigerant gas received from evaporator 16 and discharges the gas to condenser 12 where it is condensed as a result of heat exchange with a cooling medium such as air or water.

Condensed, cooled liquid refrigerant is delivered from the condenser to metering device 14 where, by the process of expansion, the pressure and temperature of the refrigerant is still further reduced. The relatively cold liquid refrigerant is then delivered to evaporator 16 and is brought into heat exchange contact with a medium, most typically air in residential air conditioning applications, so as to cool and dehumidify that medium which is then delivered to a location requiring temperature conditioning. The refrigerant gas generated in the evaporator is drawn back into compressor 10 as low pressure suction gas where the cycle starts anew.

Referring additionally now to FIG. 2, compressor 10, in the preferred embodiment, is comprised of a hermetic shell 18 in which a motor-compressor 20, comprised of motor 22 and compression mechanism 24, is disposed. Motor 22 is disposed above compression mechanism 24 and is comprised of a stator 26 and a rotor 28. A gap 30 is defined between motor stator 26 and motor rotor 28.

Suction gas enters shell 18 of compressor 10 through suction inlet 32 and fills the interior of shell 18. Disposed in the lower portion of shell 18 is a lubricant sump 34 which provides lubricant to the surfaces in compression mechanism 24 that require lubrication. In the preferred embodiment, compression mechanism 24 is of the reciprocating type in which at least one piston 24*a* reciprocates within a cylinder 24*b* to effect the compression of refrigerant gas. Once compressed, high pressure refrigerant gas is discharged out of the shell 18 of compressor 10 through discharge gas outlet 36 to the condenser located downstream of compressor 10.

Operation of compression mechanism 24 is predicated on its being driven, through drive shaft 37, by motor 22 which, in the preferred embodiment, is an electric motor. The driving of compression mechanism 24 by motor 22 causes motor 22 to become heated and the temperature of motor 22 can, under certain load conditions, rise significantly. In order to ensure that motor 22 continues to operate and does not overheat under any of the operating conditions expected to be encountered by the refrigeration system in which compressor 10 is employed, proactive cooling of motor 22 must be provided for, particularly in the location of its end turns 38.

Figure 4:
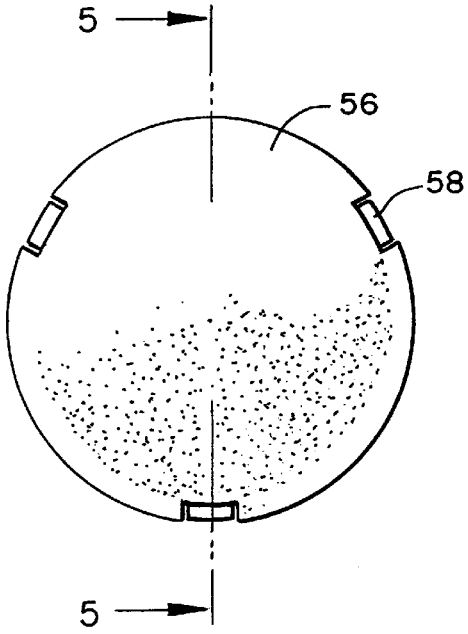
FIGS. 4 and 5 are top and side views of the motor end cap plug.
Figure 5:
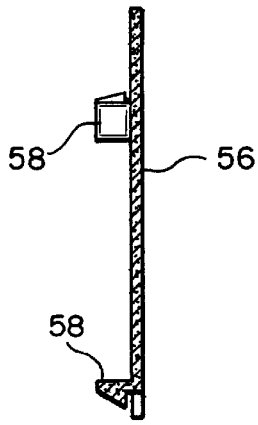

Referring additionally now to FIGS. 3, 4 and 5, a motor end cap 40 is secured to motor stator 26 on the upper end thereof. End cap 40 defines a first aperture 42 and a second aperture 44 about its peripheral surface 46, such apertures being generally on opposite sides of the periphery of the end cap. A third, closeable aperture 48 is defined in upper surface 50 of the end cap as will further be described.

Extending from peripheral surface 46 of end cap 40 are, in the preferred invention, multiple tabs 52 which each define an aperture 54. End cap 40 is secured to motor stator 26 by passing the bolts 55 which, in the preferred embodiment, also secure motor stator 26 to compression mechanism 24. Bolts 55 pass through the apertures 54 in tabs 52 and are inserted therethrough as part of the process by which the motor stator is secured to the compression mechanism.

With end cap 40 secured in place to motor stator 26, rotor-stator gap 30 is observable, measurable and settable through aperture 48 in the upper surface 50 of the motor end cap 40. This permits the motor-stator gap to be adjusted with end cap 40, as well as stator 26, secured in place. Once rotor-stator gap 30 is adjusted and set, third aperture 48 in upper surface 50 of end cap 40 is conveniently and quickly closed by the snap-in insertion of end cap closure member 56 thereinto. Member 56 has a series of tangs 58 which, when closure member 56 is pressed into third aperture 48 of the end cap, snap into and engage the edge 60 of that end cap aperture. Closure member 56 is thereby secured to the end cap and closes aperture 48.

Referring additionally now to FIGS. 6 and 7, suction screen 62, which is snap-fit into first aperture 42 of end cap 40 and which serves to prevent the admission of particulate and other debris into the interior 64 of the end cap is illustrated. Suction screen 62, like end cap closure member 56 is preferably a molded piece fabricated from plastic or another engineered material. As such, it has sufficient resiliency to permit it to be snapped into and secured to the edge of the end cap suction aperture 42 which it is designed to engage.

Suction screen 62 defines a plurality of relatively small openings 66 in face surface 68 which overlies and extends beyond the edge of the area defined by suction aperture 42 of the end cap. Face openings 66 are small enough to permit suction gas flow therethrough but to catch and trap any potentially damaging debris or particulate that might otherwise be carried into the interior 64 of end cap 40 in the flow stream of suction gas that is drawn through suction aperture 42 of the end cap when compressor 10 is in operation. As such, particulate of a size which could potentially damage motor-compressor 20 is not permitted to enter the interior of end cap 40 enroute to the compression mechanism. As will be apparent, because face openings 66, even though numerous, are relatively small and can become clogged with particulate, they of themselves can be an impediment to suction gas flow and would, if not otherwise accounted for, cause a disadvantageous and efficiency-robbing pressure drop in the suction gas flow stream as it makes its way to compression mechanism 24 through the interior 64 of the motor end cap. It is to be noted that the pattern of openings 66 is consistent across the entire face of surface 68 of the suction screen although only a portion of such openings are illustrated in FIGS. 6 and 7.

Referring additionally now to FIG. 8, in order to minimize pressure drop in the suction gas flow stream resulting from the use of suction screen 62, face surface 68 of screen 62 stands a distance "D" off of peripheral surface 46 of end cap 40 and screen 62 in cooperation with peripheral surface 46 defines essentially unobstructed side openings 70 by which suction gas can enter end cap 40 without passing through screen openings 66. In that regard, screen 62 is snapped into aperture 42 of end cap 40 and is retained therein by tabs 72 which are at the distal ends of legs 74 of the suction screen. Face 68 of screen 62 cooperates with curved peripheral surface 46 of end cap 40 to define the relatively large side openings 70 into the interior of the end cap. Suction gas can therefore enter into the interior 64 of end cap 40 through openings 70 unimpeded by face 68 of the suction screen or the openings 66 defined therein.

As will be appreciated, however, in order to enter side openings 70 and suction aperture 42, suction gas must appreciably change direction so as to flow around face 68 of the suction screen which extends, once again, over and beyond the edges of the area defined by the suction aperture.

As a result of the directional change in the suction gas flow stream that is necessary to its entry into side opening 70 and suction aperture 42, particulate of a predetermined size/mass in the suction gas flowstream not caught by direct impact with face 68 of the suction screen is prone to impacting peripheral surface 46 of end cap 40, even as the flow stream changes direction so as to enter aperture 42. Such particulate tends to be deflected away from openings 70 and suction aperture 42 due to the curvature of the end cap's peripheral surface 46 away from the suction aperture.

Therefore, while suction screen 62 is highly effective in preventing the entry of particulate or debris into the interior of the motor end cap, it does not cause significant pressure drop in the suction gas flow stream as a result of its cooperative definition with end cap 40 of relatively large, unimpeded side openings 70. Suction gas flow through and around suction screen 62 is illustrated by arrows 76 in FIG. 8. It is to be noted that when once compressor 10 shuts down and the flow of suction gas into the end cap ceases, at least some of any particulate caught in openings 66 of the suction screen while the compressor was operating will be prone to falling downwardly thereoffof by force of gravity into sump 34 where it will permanently settle or be trapped in the lubricant filtering process.

Once within the interior 64 of end cap 40, suction gas flows through and around the upper portion of motor 22 in the vicinity of its end turns 38 thereby cooling that particular motor location which tends to be a higher temperature motor location. After having been drawn through the interior 64 of end cap 40, suction gas is drawn out of second aperture 44 of end cap 40 and into suction tube 76. Suction tube 76 can be attached to end cap 40 in many ways, including snap-fit thereinto, and its purpose is to communicate suction gas from the interior of end cap 40 to cylinder 24*b* for compression by the reciprocation of piston 24*a* within the cylinder.

As a result of the employment of end cap 40, suction screen 62 and end cap closure member 56, the compressor of the present invention provides a flow path for suction gas which achieves highly effective cooling of the compressor drive motor, reduces the potential for compressor damage by preventing the entry of debris and particulate into or onto the compressor's drive motor and compression apparatus and does so in a manner which minimizes pressure drop in the suction gas flow stream. Overall efficiency of the compressor is thereby enhanced as is the process of compressor manufacture as a result of maintaining the rotor-stator gap of the compressor drive motor observable and accessible during the compressor assembly process.

Referring additionally now to FIGS. 9 and 10, an alternative embodiment to the motor end cap of the present invention is illustrated. In the embodiment of FIGS. 9 and 10, suction screen 62 is not made use of and rather than there being a separate suction screen disposed within a defined suction screen aperture in the motor end cap, a series of integral angled louvers 80 are formed in peripheral surface 46 of the end cap 40 in that location. The openings 82 between louvers 80 are the openings through which suction gas flows into the interior 64 of the end cap 40. If the end cap is fabricated from an engineered material, angled louvers 80 would simply be formed in the geometry shown during the end cap molding process. If end cap 40 were formed from metal, angled louvers 80 could be formed by a stamping process.

In the alternative embodiment, suction inlet 32 through which suction gas flows into the shell of the compressor will preferably be situated so that the flow of suction gas to louvers 80 is at an angle thereto and is such that any particulate in the gas stream which impacts the louvers tends to be deflected away from the end cap while suction gas is drawn into the openings 82 therebetween. Suction gas flow direction in this embodiment is illustrated by arrows 86. While the alternative embodiment offers certain advantages with respect to simplicity and, potentially, cost of manufacture, the alternative embodiment is not as advantageous as the preferred embodiment with respect to its impact on pressure drop in the suction gas flow stream.

While the present invention has been taught in terms of a preferred and an alternative embodiment, it will be appreciated that there are many modifications thereto that fall within its scope and the scope of the claims which follow.

What is claimed is:

1. A hermetic refrigeration compressor comprising:

a shell, said shell defining an inlet through which suction gas is received into said compressor;

compression apparatus disposed in said shell to which said suction gas flows;

a motor disposed in said shell for driving said compression apparatus, said motor being disposed vertically above said compression apparatus and including a rotor and a stator, said rotor and said stator defining a rotor-stator gap;

a drive shaft, the rotor of said motor being mounted on said drive shaft and being driven thereby, said drive shaft being drivingly connected to said compression apparatus;

a motor end cap, said end cap defining a suction aperture, through which suction gas enters the interior of said end cap enroute to said compression apparatus, and a closeable aperture, said end cap overlying said motor, said rotor-stator gap being accessible through said end cap when said closeable aperture of said end cap is open;

a suction tube, said suction tube defining a flow path for suction gas from the interior of said end cap to said compression apparatus; and a closure member, said closure member being disposed in said closeable aperture of said end cap and being spaced apart from said motor and said drive shaft, said closure member cooperating with said end cap to define a flow path for suction gas past the upper end of said motor stator enroute to said suction tube.

2. The compressor according to claim 1 wherein said end cap includes means for preventing the entry of debris carried in said suction gas into the interior thereof.

3. The compressor according to claim 2 wherein said means for preventing the entry of debris into the interior of said end cap comprises a suction screen, said screen having a face surface which defines a plurality of face openings therein.

4. The compressor according to claim 3 wherein said face surface stands off from and overlies said suction aperture of said end cap and wherein said suction screen cooperates with said end cap to define a plurality of essentially unobstructed openings other than and of significantly greater size than the size of said openings defined in said face surface, entry of suction gas into said unobstructed openings and into the interior of said end cap through said suction gas aperture requiring a change in direction in said suction gas as it flows to and through said suction aperture enroute to said compression apparatus.

5. The compressor according to claim 4 wherein said end cap has a top surface and a peripheral surface depending therefrom, said closeable aperture being defined in said top surface and said suction aperture being defined in said peripheral surface.

6. The compressor according to claim 5 wherein said face surface of said suction screen extends outwardly beyond the edge of said suction aperture in said end cap.

7. The compressor according to claim 6 wherein both said suction screen and said closure member snap into the apertures defined in said end cap in which they are accommodated.

8. The compressor according to claim 1 further comprising a suction screen, said suction screen overlying said suction aperture of said end cap and cooperating with said end cap to define at least one essentially unobstructed flow opening between said face surface and a cooperating surface of said end cap, said face surface defining a plurality of openings, said openings being smaller than said essentially unobstructed opening and being sized to catch and prevent the entry of debris larger than a predetermined size into the interior of said end cap through said face surface.

9. The compressor according to claim 8 wherein said end cap includes an upper surface and a curved peripheral surface, said curved peripheral surface being said surface which cooperates with said face surface of said suction screen to define at least one essentially unobstructed flow opening between said face surface and said end cap, said closeable aperture being defined in said upper surface of said end cap.

10. The compressor according to claim 1 wherein said closeable aperture of said motor end cap, when open, is sized and positioned so as to permit access to said rotor-stator gap.

11. The compressor according to claim 10 wherein said motor end cap has an upper surface and a peripheral surface, said closeable aperture being defined in said upper surface and said suction aperture being defined in said peripheral surface.

12. The compressor according to claim 11 further comprising apparatus for preventing the entry of particulate carried in suction gas flowing to said compression apparatus into the interior of said end cap through said suction aperture.

13. The compressor according to claim 12 wherein said apparatus for preventing the entry of particulate into the interior of said end cap includes a surface which overlies said suction aperture, said surface defining a plurality of openings sized to prevent the passage of particulate of a predetermined size therethrough, said apparatus for preventing the entry of particulate into the interior of said end cap cooperating with said peripheral surface of said end cap to define at least one essentially unobstructed opening into the interior of the motor end cap, entry of suction gas into the interior of said end cap through said unobstructed opening requiring a change in flow direction in said suction gas.

14. The compressor according to claim 13 wherein said surface of said apparatus for preventing the entry of particulate into the interior of said end cap stands off of said peripheral surface of said end cap.

15. The compressor according to claim 1 further comprising means for preventing the entry of debris carried in said suction gas into the interior of said end cap.

16. The compressor according to claim 1 wherein said motor and is secured to said compression apparatus in said shell, the stator of said motor being secured to said compression apparatus, said end cap being secured to said stator of said motor by at least one of the same fasteners by which said stator of said motor is secured to said compression apparatus.

17. The compressor according to claim 16 further comprising means overlying said suction aperture for catching particulate carried toward said suction aperture in said suction gas.

18. The compressor according to claim 17 wherein said means for catching particulate is a suction screen, said suction screen cooperating with said end cap to define at least one essentially unobstructed opening for the flow of suction gas through said suction aperture into the interior of said end cap, the passage of suction gas through said at least one opening and into the interior of said end cap requiring a change in the direction of flow of said suction gas.

19. The compressor according to claim 16 wherein said end cap includes an upper surface and a peripheral surface, said closeable aperture being defined in said upper surface and said peripheral surface being a curved surface, the curvature of said peripheral surface being away from the direction of flow of suction gas toward said suction aperture so that any particulate contained in said suction gas that impacts said peripheral surface is deflected away form said suction aperture.

20. The compressor according to claim 16 wherein said closure member is fabricated from a material other than metal and is secured in said closeable aperture by snap-fit thereinto.

21. The compressor according to claim 18 wherein said end cap includes a plurality of integrally formed angled louvers in said suction aperture, said louvers being at an angle with respect to the flow of suction gas through said shell and to said suction aperture such that any particulate carried in said suction gas is deflected by said louvers away from said suction aperture.

22. The compressor according to claim 2 wherein said means for preventing the entry of debris carried in said suction gas into the interior of said end cap comprises a plurality of angled louvers integrally formed by said end cap in said suction aperture.

23. The compressor according to claim 3 wherein said suction screen is fabricated from a material other than metal and includes a plurality of legs extending from said face surface, said suction screen being secured to said end cap by snap-fit into said suction aperture, said legs causing said face surface of said suction screen to be positioned to stand off of and away from said end cap and to define a plurality of relatively unobstructed openings, other than said openings in said face, through which said suction gas can flow into the interior of said end cap without passing through said face openings.

24. A hermetic refrigeration compressor comprising:

a shell, said shell defining an inlet through which suction gas is received into said compressor;

compression apparatus disposed in said shell;

a motor disposed in said shell for driving said compression apparatus;

a motor end cap, said end cap defining a suction aperture, through which suction gas enters the interior of said end cap enroute to said compression apparatus, said end cap overlying said motor; and apparatus having a surface overlying said suction aperture, said surface permitting the flow of suction gas therethrough but preventing the flow of particulate of a predetermined size therethrough into said suction aperture, said apparatus cooperating with said end cap to define at least one essentially unobstructed flow opening, other than through said surface and of a size greater than said predetermined size, into the interior of said end cap, passage of suction gas through said essentially unobstructed opening and through said suction aperture and into the interior of said end cap requiring a change in the flow direction of said suction gas.

25. The compressor according to claim 24 wherein said apparatus comprises a suction screen, said screen having a face surface which defines a plurality of face openings therein, said face surface standing off of said end cap.

26. The compressor according to claim 25 wherein said face surface of said suction screen overlies and extends outwardly beyond the edge of said suction aperture.

27. The compressor according to claim 26 wherein said suction screen includes a plurality of legs extending from said face surface, said suction screen being secured to said end cap by snap-fit into said suction aperture.

28. The compressor according to claim 27 wherein said suction screen is fabricated from a material other than metal, at least two of said legs of said suction screen each having a tab, said tabs engaging said suction screen by snap-fit and securing said suction screen in place.

29. The compressor according to claim 24 wherein in addition to said suction aperture, said motor end cap defines a closeable aperture and wherein said motor includes a rotor and a stator, said closeable aperture, when open, being sized and positioned so as to permit access to said rotor-stator gap, said compressor further comprising a closure member, said closure member being attachable to said end cap to close said closeable aperture.

30. The compressor according to claim 29 wherein said apparatus overlying said suction aperture comprises a suction screen, said suction screen having a face surface which defines a plurality of face openings therein, said face surface standing off of said end cap.

31. The compressor according to claim 30 wherein said closure member and said suction screen are fabricated from a material other than metal, each of said closure member and said suction screen being secured by snap-fit into the respective one of the apertures defined by said motor end cap with which it is associated.

32. A hermetic refrigeration compressor comprising:

a shell, said shell defining an inlet through which suction gas is received into said compressor;

compression apparatus disposed in said shell to which said suction gas flows;

a motor disposed in said shell for driving said compression apparatus, said motor being located above said compression apparatus and including a rotor and a stator;

a drive shaft, the rotor of said motor being mounted on said drive shaft and said drive shaft being drivingly connected to said compression apparatus;

a motor end cap, said end cap defining a closeable aperture and overlying the upper end of said motor, said rotor-stator gap being accessible through said end cap when said closeable aperture of said end cap is open;

a suction tube, said suction tube defining a flow path for suction gas from the interior of said end cap to said compression apparatus; and a closure member disposed in said closeable aperture of said end cap, said closure member cooperating with said end cap to define a generally solid and continuous surface that is spaced apart from the upper end of said motor and from said drive shaft, suction gas flowing through the space defined between said generally solid and continuous surface and the upper end of said motor stator prior to entering said suction tube.

33. The compressor according to claim 32 wherein said motor is secured to said compression apparatus in said shell and wherein said end cap is secured to said stator by at least one of the same fasteners by which said stator is secured to said compression apparatus.

34. The compressor according to claim 33 wherein said end cap defines a suction aperture, said suction aperture being an aperture through which suction gas flows enroute to said compression apparatus, said compressor further comprising means for preventing the entry of particulate into the interior of said end cap through said suction aperture.

35. The compressor according to claim 34 wherein said means for preventing the entry of particulate into the interior of said end cap and said closure member are fabricated from a material other than metal.

36. The compressor according to claim 34 wherein said means for preventing the entry of particulate into the interior of said end cap and said closure member are secured by snap-fit to said end cap.

37. The compressor according to claim 33 wherein said end cap has a top surface and a peripheral surface, said closeable aperture being defined in said top surface.

38. The compressor according to claim 37 wherein said end cap defines a suction aperture in said peripheral surface thereof and further comprising a suction screen, said suction screen overlying said suction aperture and having a face surface, said face surface defining a plurality of relatively small openings, said openings being sized to catch and prevent the entry of debris larger than a predetermined size into the interior of said end cap through said face surface.

39. The compressor according to claim 38 wherein said suction screen cooperates with said peripheral surface of said end cap to define at least one essentially unobstructed flow opening between said face surface of said suction screen and said peripheral surface of said end cap, suction gas flowing into the interior of said end cap through said cooperatively defined flow opening being required to change direction in order to do so.

40. The compressor according to claim 39 wherein said peripheral surface is a curved surface, said peripheral surface curving away from said suction aperture and said cooperatively defined flow opening.

41. The compressor according to claim 37 wherein said end cap defines a suction aperture through which suction gas flows enroute to said compression apparatus and further comprising a plurality of louvers disposed in said suction aperture, said louvers being angled so as to deflect particulate carried in suction gas flowing into said suction aperture away therefrom.

* * * * *

UNITED STATES PATENT AND TRADEMARK OFFICE

CERTIFICATE OF CORRECTION

PATENT NO. : 6,254,354 B1 
DATED : July 3, 2001
INVENTOR(S) : W. J. Sonnier, Jr. and Kendall D. Davenport It is certified that error appears in the above-identified patent and that said Letters Patent is hereby corrected as shown below:

Column 7,
Line 12, after the words, "said suction screen" insert -- having a face surface and --.
Line 62, delete "and".

Signed and Sealed this

Nineteenth Day of August, 2003

JAMES E. ROGAN
*Director of the United States Patent and Trademark Office*